US006361116B1

(12) United States Patent
Herbert

(10) Patent No.: US 6,361,116 B1
(45) Date of Patent: Mar. 26, 2002

(54) ERGONOMIC SEAT WITH INCLINED FEMORAL PORTION

(75) Inventor: Jeffrey Herbert, Heidelberg Victoria (AU)

(73) Assignee: Heygarth South Pty Ltd., Victoria (AU)

( * ) Notice: Subject to any disclaimer, the term of this patent is extended or adjusted under 35 U.S.C. 154(b) by 0 days.

(21) Appl. No.: 09/601,299

(22) PCT Filed: Jan. 29, 1999

(86) PCT No.: PCT/AU99/00066

§ 371 Date: Jul. 31, 2000

§ 102(e) Date: Jul. 31, 2000

(87) PCT Pub. No.: WO99/38419

PCT Pub. Date: Aug. 5, 1999

(30) Foreign Application Priority Data

Feb. 2, 1998 (AU) ..... PP 1570

(51) Int. Cl.[7] ..... A47C 7/02
(52) U.S. Cl. ..... 297/452.27; 5/653
(58) Field of Search ..... 297/452.27, 452.26, 297/452.23; 5/653; D6/601

(56) References Cited

U.S. PATENT DOCUMENTS

| | | | | | |
|---|---|---|---|---|---|
| 4,690,459 | A | | 9/1987 | Ullman | |
| 4,696,516 | A | * | 9/1987 | Yeum | 297/452.27 X |
| 4,837,881 | A | * | 6/1989 | Kondo et al. | 5/653 |
| 4,930,171 | A | * | 6/1990 | Frantz | 5/653 X |
| 5,137,333 | A | | 8/1992 | Chee | |
| 5,317,773 | A | * | 6/1994 | Graebe | 5/653 |
| 5,452,940 | A | | 9/1995 | Maier | |
| 5,687,436 | A | * | 11/1997 | Denton | 5/653 |
| 5,791,736 | A | | 8/1998 | Herbert | |

FOREIGN PATENT DOCUMENTS

| | | | | |
|---|---|---|---|---|
| AU | 73415/87 | | 12/1987 | |
| CA | 957440 | * | 11/1974 | 5/653 |
| CH | 558158 | | 12/1974 | |
| DE | 1115421 | | 10/1961 | |
| GB | 2006618 | | 5/1979 | |
| WO | 8607528 | | 12/1986 | |
| WO | 8707124 | | 12/1987 | |
| WO | 9103969 | | 4/1991 | |
| WO | 9215232 | | 9/1992 | |
| WO | 9506424 | | 3/1995 | |

* cited by examiner

*Primary Examiner*—Jerry Redman
(74) *Attorney, Agent, or Firm*—James Ray & Associates

(57) ABSTRACT

A seat includes a seat portion connected to a base so that it can be supported on the ground. In addition to a front, a rear and two sides, the seat portion has an upwardly inclined portion, an inclined support portion, and a substantially flat horizontal portion. The upwardly inclined portion inclines upwardly from the front of the seat portion to a first intermediate position between the front and rear of the seat portion. The inclined support portion extends between a second intermediate position and the rear of the seat portion. The horizontal portion extends from the first intermediate position to the second intermediate position. The upwardly inclined portion supports the femurs and knees in a position below a person's acetabulum. The horizontal portion receives and holds the ischial bones when the person sits down, and the inclined support portion supports the gluteal muscles and sacra iliac ligaments.

10 Claims, 1 Drawing Sheet

ERGONOMIC SEAT WITH INCLINED FEMORAL PORTION

FIELD OF THE INVENTION

This invention relates to a seat such as a chair but also includes other seating appliances such as sofas, couches, stools and the like. This invention relates to an improvement or modification to the seat disclosed in our international application No. PCT/AU94/00513 (WO 95/06424). The contents of this international application are incorporated into this specification by this reference.

BACKGROUND ART

The seat disclosed in the above-mentioned international application is intended to improve seating posture and to ensure that proper bodily functions are not impaired or adversely affected when a person is seated.

This invention relates to further improvements or modifications to further improve seating posture.

SUMMARY OF THE INVENTION

A first aspect of the present invention may be said to reside in a seat including:

a seating portion for connection to a base so that the seating apparatus can be supported on the ground, said seat portion having a front, a rear and two sides;

said seat portion having, (a) an upwardly inclined portion which inclines upwardly from the front of the seat portion to a first intermediate position between the front and rear of the seat portion, (b) an inclined support portion extending between a second intermediate position and the rear of the seat portion, and (c) a substantially flat horizontal position extending from the first intermediate position to the second intermediate position;

wherein the upwardly inclined portion is for supporting the femurs of a person so that the femurs and knees are supported in a position below the person's acetabulum, said substantially flat horizontal portion being for receiving and holding the ischial bones when the person sits down and said inclined support portion being for supporting the person's gluteal muscles and sacra iliac ligaments;

the upwardly inclined portion including a first cushioning material;

the flat horizontal portion including a second cushioning material;

the first cushioning material being denser than the second cushioning material so that when a person sits on the seating apparatus, the second cushioning material is compressed and holds the ischial bones and the first cushioning material which is of higher density than the second cushioning material prevents a person from slipping forward on the seat; and the upwardly inclined portion being curved or concave so that side parts of the upwardly inclined portion adjacent the two sides of the seat portion are closer to the front of the seat than a mid portion of the upwardly inclined portion, the side parts overlapping the substantially flat horizontal portion and the second intermediate position being substantially at the said mid-portion of the inclined support portion.

Preferably the substantially flat horizontal portion is formed from the same cushioning material as the upwardly inclined portion and the inclined support portion and is mechanically altered to provide a density which is less than the density of the upwardly inclined portion and the inclined support portion.

Preferably the cushioning material of the substantially flat horizontal portion is mechanically altered by providing cuts or grooves in the cushioning material to decrease the density of the cushioning material.

Preferably the upwardly inclined portion, the inclined support portion and substantially flat horizontal portion include an integral cushioning member.

Another aspect of the invention may be said to reside in a seat including:

a seating portion for connection to a base so that the seating apparatus can be supported on the ground, said seat portion having a front and a rear;

said seat portion having, (a) an upwardly inclined portion which inclines upwardly from the front of the seat portion to a first intermediate position between the front and rear of the seat portion, (b) an inclined support portion extending between a second intermediate position and the rear of the seat portion, and (c) a mid portion extending from the first intermediate position to the second intermediate position;

wherein the upwardly inclined portion is for supporting the femurs of a person so that the femurs and knees are supported in a position below the person's acetabulum, said mid portion being for receiving and holding the ischial bones when the person sits down and said inclined support portion being for supporting the person's gluteal muscles and sacra iliac ligaments;

the upwardly inclined portion including a first cushioning material;

the mid portion including a second cushioning material;

the first cushioning material being denser than the second cushioning material so that when a person sits on the seating apparatus, the second cushioning material compressed and holds the ischial bones and the first cushioning material which is of higher density than the second cushioning material prevents a person from slipping forward on the seat; and the first and second cushioning material being formed from dense cushioning material and the second cushioning material being mechanically altered to decrease its density so as to provide the second cushioning material with a density which is less than the first cushioning material.

Preferably the second cushioning material is mechanically altered by providing cuts or grooves in the second cushioning material to thereby enable the cushioning material to compress more than the first cushioning material.

Preferably the inclined support portion is formed from a third cushioning material which is of substantially the same density as the first cushioning material.

Preferably the first cushioning material, second cushioning material and third cushioning material include an integral cushioning member of cushioning materials and wherein the integral cushioning member is provided with cuts or grooves to decrease the density of the cushioning member in the vicinity of the cuts and grooves to thereby provide the second cushioning material which is less dense than the first cushioning material.

Preferably the inclined support portion includes a wedge-shaped cushioning member of dense cushioning material which is coupled to the integral cushioning member to form the inclined support portion, the wedge-shaped cushioning member being formed from a fourth cushioning material which is denser than the second cushioning material.

Preferably the first cushioning material is the same as the fourth cushioning material.

BRIEF DESCRIPTION OF THE DRAWINGS

A preferred embodiment of the invention will be described, by way of example, with reference to the accompanying drawings, in which.

DESCRIPTION OF THE PREFERRED EMBODIMENT

With reference to the drawings, a seat 10 is shown which includes a base plate 12. The base plate 12 is to be connected to a stand (not shown) which may include adjustment mechanisms for altering the height and also possibly the inclination of the seat 10. A back rest (not shown) may also be coupled to the stand.

Figure 1:
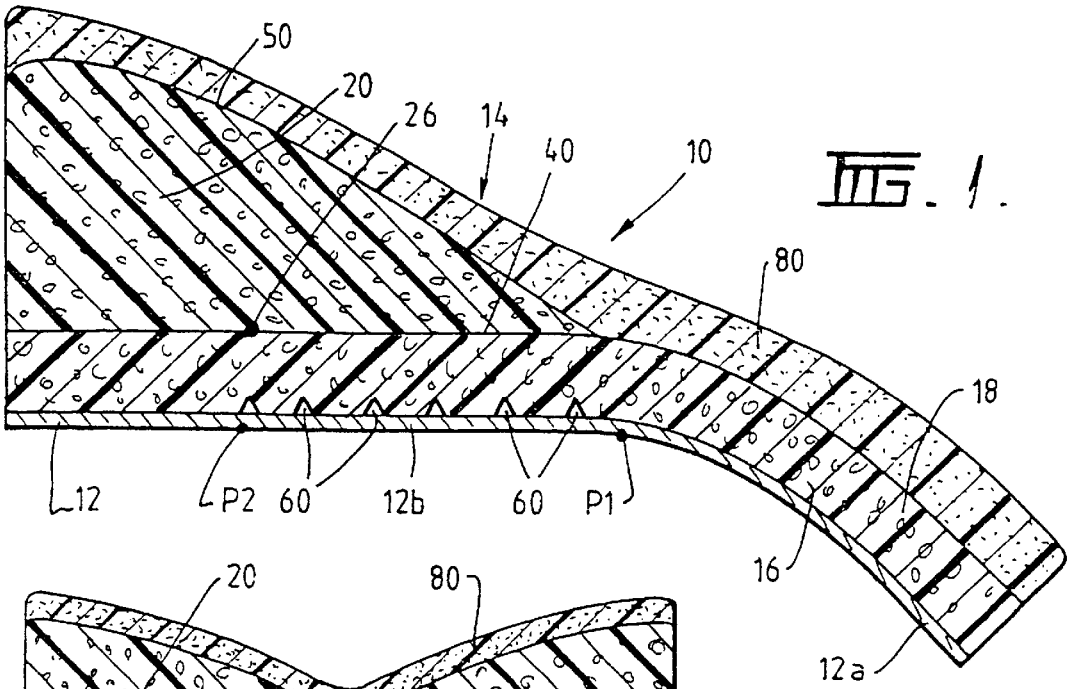
FIG. 1 is a side view of a seat embodying the invention.
Figure 4:
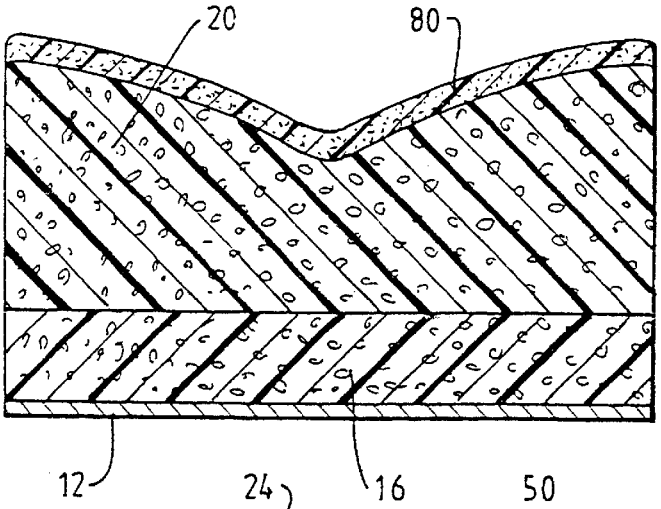
FIG. 4 is a rear view of the seat of FIG. 1.
Figure 3:
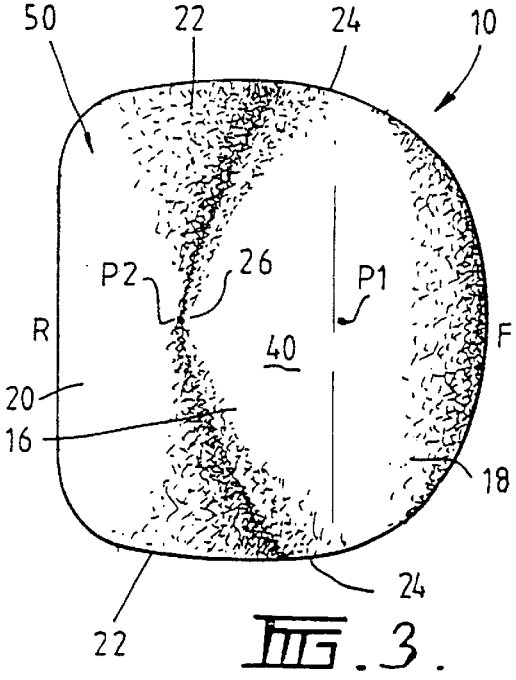
FIG. 3 is a plan view of the seat of FIG. 1.

The base plate 12 includes a front inclined portion 12*a* which merges into a substantially flat section 12*b*. The seat 10 includes a seating portion generally designated by reference 14 which is connected to the base plate 12 by adhering the seating portion 14 to the base plate 12. The seating portion 14 includes a cushioning member 16 of high density which may be cut from a block of high density foam material. When the cushioning member 16 is cut from the block of foam or otherwise provided, it will generally be in the form of a flat panel or sheet. When the member 16 is adhered to the base plate 12, the member 16 will take up the shape of the base plate 12 to provide an upwardly inclined portion 18 which will be described in more detail hereinafter. A cushioning member 20 of wedge-shaped configuration in side view shown in FIG. 1 and of generally curve or concave configuration in plan as shown in FIG. 3 is adhered to the member 16. As is best shown in FIG. 3, the member 20 has side parts 22 adjacent sides 24 of the seating portion 14 which extend closer to front F of the seat then a mid-portion 26 on a front edge of the member 20. The member 20 provides a bowl-shaped or curved support region toward the rear of the seat.

The upwardly inclined portion 18 extends from the front F of the seat 10 to a first intermediate point P1.

A generally horizontal flat portion extends from the intermediate point P1 to a second intermediate point P2 which may coincide with the midpoint 26 which is the part of the front edge 30 of the member 20 which is closest to the rear R of the seat.

Figure 2:
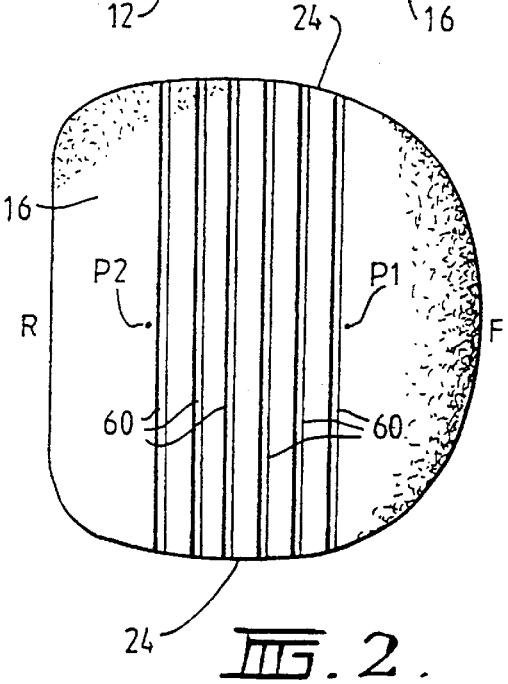
FIG. 2 is an underneath view of the seat of FIG. 1.

A substantially flat region 40 is provided between the first intermediate point P1 and the second intermediate point P2. As is best shown in FIG. 2, part of the side portions 22 of the member 20 overlap the horizontal portion 40 at the sides 24 of the seat portion 14.

The wedge-shaped member 20 in combination with the member 16 define an inclined support portion 50 which extends from the point P2 at the mid-portion 26 of the seat 10 to the rear of the set and which also curves forwardly towards the side edge of the seat 24 to overlap the horizontal portion 40 as described above. The concave or curved wedge member 20 therefore provides a generally bowl-shaped rear inclined support portion 50 which extends from the second intermediate point P2 to the rear R of the seat 10.

The cushioning member 16 which forms the upwardly inclined portion 18, the flat horizontal portion 40 and the lower part of the inclined support portion 50 is formed from high density cushioning material. The wedge member 20 is also formed from the same high density cushioning material 20 and, as is explained above, may be glued to the member 16. Alternatively, the members 16 and 20 could be cut from a block of high-density cushioning material and formed integrally rather than separately as described above.

The flat portion 40 is made to be of less density than the upwardly inclined portion 18 and also the inclined support portion 50 by providing a plurality of V-shaped grooves or cuts 60 in the cushioning member 16 between the points P1 and P2. The grooves or cuts 60 extend right across the lower surface of the cushioning member 16 from one side 24 to the other side 24 of the seating portion 14. The cuts 60 act to mechanically alter the cushioning material 60 in the vicinity between the points P1 and P2 so as to reduce the overall density of the cushioning material between the points P1 and P2 and therefore of the flat horizontal portion 40 as compared to the upwardly inclined portion 18 and the inclined support portion 50.

In use, the upwardly inclined portion 18 supports the femurs of a person so that the femurs and knees are supported in a position below the person's acetabulum. The horizontal flat portion 40 receives and holds the ischial bones when the person sits down and the inclining support portion wraps around and supports the person's gluteal muscles and sacra iliac ligaments. The lower density of the horizontal portion 40 results in that portion compressing more than the upwardly inclined portion 18 and also the inclined support portion 50 so as to hold the ischial bones and prevent a person from slipping forward. This compression generally forms a slight bowl or dishing of the horizontal portion 40 whilst the inclined portion 18 remains substantially uncompressed so as to form a barrier between the compressed horizontal portion 40 and the inclined support portion 18 which prevents a person from slipping forward or sliding on the seat.

Preferably the upwardly inclined portion 18 is angled at an angle of approximately 30° to 50° with respect to the horizontal and the rear inclined support portion 50 is angled at an angle of approximately 30° to 50° with respect to the horizontal.

The length of the generally horizontal portion between the points P1 and P2 is in the order of 160 to 180 mm.

The seating portion 14 may be completed by an upper upholstery or cushioning member 80 which extends completely over the upper surface of the seating portion 40 and which is formed from relatively low density foam material. A fabric cover or the like (not shown) may be provided over the seating portion 14 to complete the seat 10.

Since modifications within the spirit and scope of the invention may readily be effected by persons skilled within the art, it is to be understood that this invention is not limited to the particular embodiments described by way of example hereinabove.

What is claimed is:

1. A seat including:

a seat portion for connection to a base so that the seat portion can be supported on the ground, said seat portion having a front, a rear and two sides;

said seat portion having, (a) an upwardly inclined portion which inclines upwardly from the front of the seat portion to a first intermediate position between the front and rear of the seat portion, (b) an inclined support portion extending between a second intermediate position and the rear of the seat portion, and (c) a substantially flat horizontal portion extending from the first intermediate position to the second intermediate position;

wherein the upwardly inclined portion is for supporting the femurs of a person so that the femurs and knees are supported in a position below a person's acetabulum, said substantially flat horizontal portion being for receiving and holding the ischial bones when the person sits down and said inclined support portion being for supporting the person's gluteal muscles and sacra iliac ligaments;

the upwardly inclined portion including a first cushioning material;

the flat horizontal portion including a second cushioning material;

the first cushioning material being denser than the second cushioning material so that when a person sits on the seat portion, the second cushioning material is compressed and holds the ischial bones and the first cushioning material which is of higher density than the second cushioning material prevents a person from slipping forward on the seat; and the upwardly inclined portion being curved or concave so that side parts of the upwardly inclined portion adjacent the two sides of the seat portion are closer to the front of the seat than a mid portion of the upwardly inclined portion, the side parts overlapping the substantially flat horizontal portion and the second intermediate position being substantially at the mid-portion of the inclined support portion.

2. The seat of claim 1, wherein the substantially flat horizontal portion is formed from the same cushioning material as the upwardly inclined portion and the inclined support portion and is mechanically altered to provide a density which is less than the density of the upwardly inclined portion and the inclined support portion.

3. The seat of claim 1, wherein the cushioning material of the substantially flat horizontal portion is mechanically altered by providing cuts or grooves in the cushioning material to decrease the density of the cushioning material.

4. The seat of claim 1, where in the upwardly inclined portion, the inclined support portion and substantially flat horizontal portion include an integral cushioning member.

5. A seat including:

a seat portion for connection to a base so that the seat portion can be supported on the ground, said seat portion having a front and a rear;

said seat portion having, (a) an upwardly inclined portion which inclines upwardly from the front of the seat portion to a first intermediate position between the front and rear of the seat portion, (b) an inclined support portion extending between a second intermediate position and the rear of the seat portion, and (c) a mid portion extending from the first intermediate position to the second intermediate position;

wherein the upwardly inclined portion is for supporting the femurs of a person so that the femurs and knees are supported in a position below a person's acetabulum, said mid portion being for receiving and holding the ischial bones when the person sits down and said inclined support portion being for supporting the person's gluteal muscles and sacra iliac ligaments;

the upwardly inclined portion including a first cushioning material;

the mid portion including a second cushioning material;

the first cushioning material being denser than the second cushioning material so that when a person sits on the seat portion, the second cushioning material is compressed and holds the ischial bones and the first cushioning material which is of higher density than the second cushioning material prevents a person from slipping forward on the seat; and the first and second cushioning material being formed from dense cushioning material and the second cushioning material being mechanically altered to decrease its density so as to provide the second cushioning material with a density which is less then the first cushioning material.

6. The seat of claim 5, wherein the second cushioning material is mechanically altered by providing cuts or grooves in the second cushioning material to thereby enable the cushioning material to compress more than the first cushioning material.

7. The seat of claim 5, wherein the inclined support portion is formed from a third cushioning material which is of substantially the same density as the first cushioning material.

8. The seat of claim 5, wherein the first cushioning material, second cushioning material and third cushioning material include an integral cushioning member of cushioning material and wherein the integral cushioning member is provided with cuts or grooves to decrease the density of the cushioning member in the vicinity of the cuts and grooves to thereby provide the second cushioning material which is less dense than the first cushioning material.

9. The seat of claim 5, wherein the inclined support portion includes a wedge-shaped cushioning member of dense cushioning material which is coupled to the integral cushioning member to form the inclined support portion, the wedge-shaped cushioning member being formed from a fourth cushioning material which is denser than the second cushioning material.

10. The seat of claim 5, wherein the first cushioning material is the same as the fourth cushioning material.

* * * * *